US007714806B2

(12) United States Patent
Moon

(10) Patent No.: US 7,714,806 B2
(45) Date of Patent: May 11, 2010

(54) PLASMA DISPLAY APPARATUS AND DRIVING METHOD THEREOF

(75) Inventor: Seonghak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 1161 days.

(21) Appl. No.: 11/269,568

(22) Filed: Nov. 9, 2005

(65) Prior Publication Data

US 2006/0097961 A1 May 11, 2006

(30) Foreign Application Priority Data

Nov. 10, 2004 (KR) ..... 10-2004-0091639

(51) Int. Cl.
*G09G 3/10* (2006.01)
*G09G 3/28* (2006.01)

(52) U.S. Cl. ..... 345/60; 345/68; 315/169.4

(58) Field of Classification Search ..... 345/30–42, 345/55–100, 204–214, 690–699; 315/169.1–169.4
See application file for complete search history.

(56) References Cited

U.S. PATENT DOCUMENTS

| | | | | |
|---|---|---|---|---|
| 5,982,344 | A * | 11/1999 | Tokunaga | 345/67 |
| 6,147,664 | A * | 11/2000 | Hansen | 345/74.1 |
| 6,624,588 | B2 | 9/2003 | Nakamura | |
| 6,707,437 | B1 * | 3/2004 | Kuno et al. | 345/74.1 |
| 6,731,275 | B2 * | 5/2004 | Mizobata | 345/209 |
| 6,762,567 | B2 * | 7/2004 | Ide | 315/169.4 |
| 6,952,193 | B2 * | 10/2005 | Abe et al. | 345/87 |
| 7,098,873 | B2 * | 8/2006 | Homma | 345/60 |
| 7,242,374 | B2 * | 7/2007 | Jeong et al. | 345/60 |
| 7,298,349 | B2 * | 11/2007 | Tachibana et al. | 345/60 |
| 7,355,568 | B2 * | 4/2008 | Homma | 345/60 |
| 2005/0062688 | A1 * | 3/2005 | Lee et al. | 345/60 |
| 2008/0055288 | A1 | 3/2008 | Kawada et al. | |

FOREIGN PATENT DOCUMENTS

| | | |
|---|---|---|
| EP | 1 195 739 | 4/2002 |
| EP | 1 271 463 | 1/2003 |
| EP | 1 365 378 | 11/2003 |
| JP | 08-320668 | 12/1996 |
| JP | 09-034396 | 2/1997 |
| JP | 09-179520 | 7/1997 |
| JP | 10-288973 | 10/1998 |
| JP | 2000-276101 | 10/2000 |
| JP | 2002-132209 | 5/2002 |
| JP | 2003-076319 | 3/2003 |
| WO | WO 2006/013658 | 2/2006 |

OTHER PUBLICATIONS

Young-Ho Jung, Seok-Il Kim, Ju Young Jeong Analysis and Design of Driving Waveforms for ac PDP's Driven by Three Wall Charge States Sep. 16, 2003 European Solid-State Device Research, pp. 465-468.*

* cited by examiner

*Primary Examiner*—David L Lewis
(74) *Attorney, Agent, or Firm*—McKenna Long & Aldridge LLP

(57) ABSTRACT

The present invention relates to a plasma display apparatus and driving method thereof. In accordance with a plasma display apparatus and driving method thereof, widths of scan pulses are different depending on locations of the scan lines. Since scan pulse widths are set depending on locations of the scan lines, high speed driving is possible, a sustain period can be secured and luminance can be increased.

20 Claims, 6 Drawing Sheets

PLASMA DISPLAY APPARATUS AND DRIVING METHOD THEREOF

CROSS-REFERENCES TO RELATED APPLICATIONS

This Nonprovisional application claims priority under 35 U.S.C. §119(a) on Patent Application No. 2004-91639 filed in Korea on Nov. 10, 2004 the entire contents of which are hereby incorporated by reference.

BACKGROUND OF THE INVENTION

1. Field of the Invention

The present invention relates to a plasma display apparatus and a driving method thereof.

2. Background of the Related Art

FIG. 1 shows a driving waveform of a conventional plasma display apparatus.

As shown in FIG. 1, a reset period can be divided into a set-up period and a set-down period.

In the set-up period, a ramp-up pulse is applied to a scan electrode Y, so that sufficient wall charges are accumulated on the scan electrode Y, a data electrode X and a sustain electrode Z.

In the set-down period, a ramp down pulse is applied to the sustain electrodes Z, so that the wall charges accumulated on the electrodes X, Y and Z are partially erased to ensure a uniform distribution of the wall charges on the electrodes X, Y and Z.

In an address period subsequent to a reset period, a scan pulse is applied to the scan electrode Y and a data pulse is applied to the data electrode X, so that a cell to be turned on is selected.

In a sustain period, sustain pulses having the same number as that of corresponding sub-fields to which the sustain pulses are allocated are applied to the selected cell in the address period, so that the selected cell is turned on.

Thereafter, in an erase period, as an erase pulse is applied to the Z electrode, wall charges that have been accumulated on the electrode are erased.

The reset period, the address period, the sustain period and the erase period are repeatedly performed in each of the sub-fields. In an address period of each sub-field, the width of the scan pulses applied to the scan electrode Y is constant as shown in FIG. 2.

A traverse axis of the graph shown in FIG. 2 indicates a scan pulse width and a longitudinal axis thereof indicates the location of the scan lines. That is, the width of scan pulses, which are applied to the scan lines from a first scan line at the top to a last scan line ($N^{th}$ line) remains constant.

The number of scan lines increases as the size and resolution of a plasma display panel increases. Therefore, since the time allocated to one scan line for scanning becomes short, there is a difference between the amount of the wall charges on the first scan line and the amount of the wall charges on the last scan line ($N^{th}$ line).

If the scan pulses having the same width are applied to the first scan line in the address period where wall charges are sufficiently accumulated by the set-up pulse applied in the reset period, the probability that an erroneous discharge or miswriting may occur decreases.

Since a significant amount of time elapses in the period from immediately after the reset period to when the last scan line ($N^{th}$ line) is scanned, there is a high probability that wall charges, which are formed on the last scan line ($N^{th}$ line) by the set-up pulse, may decrease. Therefore, if a width of a scan pulse applied to the first scan line is the same as the width of a scan pulse applied to the last scan line, an address discharge becomes unstable or the address margin decreases, and an exact driving of plasma display panel is difficult.

There is a difference in the amount of the wall charges on the respective scan lines depending on an Average Picture Level (APL) of each sub-field after a reset period. Therefore, if scan pulses having the same width are applied to the scan lines without considering an APL for each sub-field, there is a high probability of an erroneous discharge, miswriting, etc. may occur.

SUMMARY OF THE INVENTION

Accordingly, the present invention has been made in view of the above problems occurring in the prior art, and it is an object of the present invention to provide a plasma display apparatus and driving method thereof, in which the widths of scan pulse vary in consideration of the amount of the wall charges in a reset period or an APL for each sub-field.

To achieve the above object, a plasma display apparatus according to an aspect of the present invention comprises a plasma display panel in which a plurality of scan lines is arranged in parallel in a vertical direction, a timing controller that outputs a pulse width control signal for setting the widths of the scan pulse to be different from each other depending on locations of the scan lines on the plasma display panel, and a scan electrode driver that applies scan pulses to the scan lines of the plasma display panel according to the pulse width control signal received from the timing controller.

A driving method of a plasma display apparatus in which a plurality of scan lines is arranged in parallel in a vertical direction according to an aspect of the present invention comprises the steps of outputting a pulse width control signal for setting the widths of the scan pulses to be different from each other depending on locations of the scan lines on the plasma display panel and applying scan pulses to the scan lines of the plasma display panel according to the pulse width control signal.

In accordance with a plasma display apparatus and driving method thereof, scan pulse widths can be set depending on locations of scan lines. Therefore, high speed driving is possible, a sustain period can be secured and luminance can be increased.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
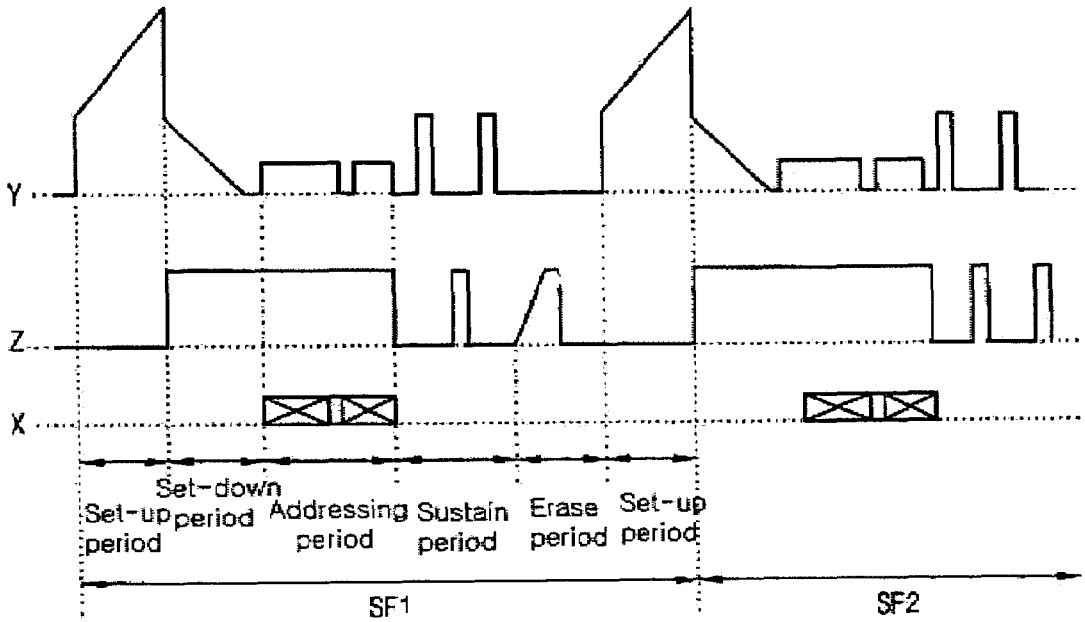
FIG. 1 shows a driving waveform of a conventional plasma display apparatus.
Figure 2:
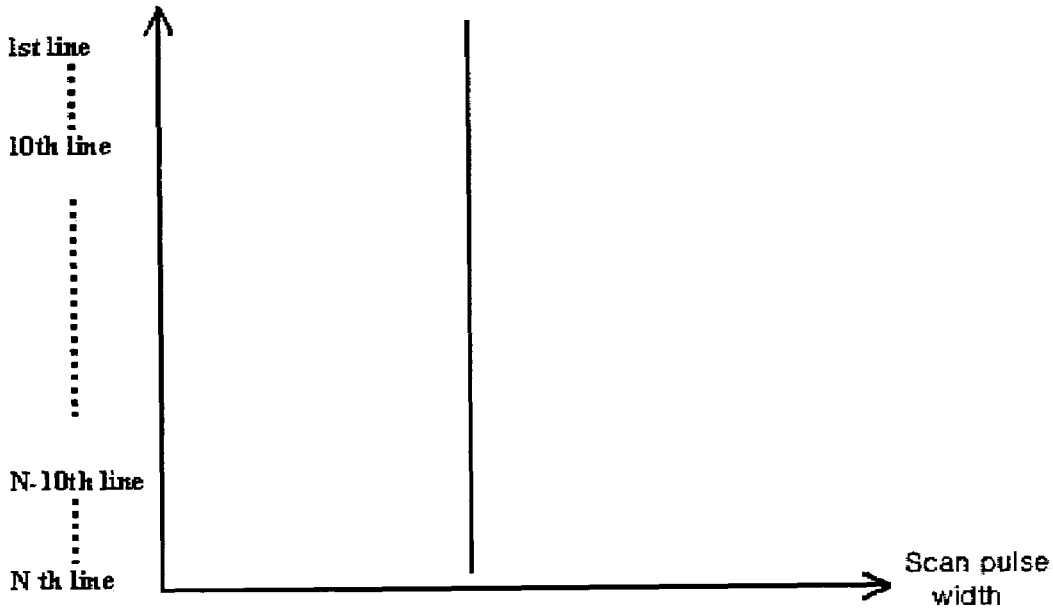
FIG. 2 is a graph showing the relationship between the location of scan lines and a scan pulse width in the related art.

A plasma display apparatus according to an aspect of the present invention comprises a plasma display panel in which a plurality of scan lines is arranged in parallel in a vertical direction, a timing controller that outputs a pulse width control signal for setting the widths of the scan pulse to be different from each other depending on locations of the scan lines on the plasma display panel, and a scan electrode driver that applies scan pulses to the scan lines of the plasma display panel according to the pulse width control signal received from the timing controller.

The timing controller outputs a timing control signal for setting one or both of a width of a reset pulse and/or a voltage level of the reset pulse applied in a reset period, and output a timing control signal for setting the widths of the scan pulses depending on one or both of the width of the reset pulse and/or the voltage level of the reset pulse, and depending on the location of either the upper or lower scan lines.

The plasma display apparatus may further comprise a data detector that determines a sub-field corresponding to a video signal, wherein the timing controller may output a pulse width control signal for setting the widths of the scan pulses depending on the sub-field and depending on the location of either the upper or lower scan lines.

The plasma display apparatus may further comprise a data detector that receives a video signal and calculates a data load of the video signal, wherein the timing controller may output a pulse width control signal for setting the widths of the scan pulses depending on the data load of the video signal and depending on the location of either the upper or lower scan lines.

The timing controller may outputs a pulse width control signal for increasing the widths of the scan pulses that are sequentially applied to each of the scan lines.

The timing controller may output a pulse width control signal for setting the widths of the scan pulses applied to the scan lines located in a first region to have a first width, may output a pulse width control signal for setting the widths of the scan pulses applied to the scan lines located in a second region subsequent to the first region to have a second width narrower than the first width, and may output a pulse width control signal for setting the widths of the scan pulses applied to the scan lines located in a third region subsequent to the second region to have a third width wider than the second width.

The timing controller may output a pulse width control signal for setting the widths of the scan pulses applied to some of the scan lines located in the second region to be narrower than the widths of the scan pulses applied to the remaining scan lines.

The timing controller outputs a pulse width control signal for setting the widths of the scan pulses applied to the scan lines located in a first region to have a first width, may output a pulse width control signal for setting the widths of the scan pulses applied to the scan lines located in a second region subsequent to the first region to have a second width wider than the first width, and may output a pulse width control signal for setting the widths of the scan pulses applied to the scan lines located in a third region subsequent to the second region to have a third width narrower than the second width.

The timing controller may outputs a pulse width control signal for setting the widths of scan pulses applied to some of the scan lines located in the second region to be wider than the widths of the scan pulses applied to the remaining scan lines.

The timing controller may output a pulse width control signal for setting the widths of the scan pulses applied to the scan lines located in a first region to be linearly reduced, may output a pulse width control signal for setting the widths of the scan pulses applied to the scan lines located in a second region subsequent to the first region to be constant, and may output a pulse width control signal for setting the widths of the scan pulses applied to the scan lines located in a third region subsequent to the second region to be linearly increased.

The timing controller may output a pulse width control signal for setting the width of the scan pulse applied to each of the scan lines to be non-linearly reduced and then to be increased non-linearly.

The timing controller may output a pulse width control signal for setting the width of the scan pulse applied to each of the scan lines to be linearly reduced and then to be increased linearly.

A driving method of a plasma display apparatus in which a plurality of scan lines is arranged in parallel in a vertical direction according to an aspect of the present invention comprises the steps of outputting a pulse width control signal for setting the widths of the scan pulses to be different from each other depending on locations of the scan lines on the plasma display panel and applying scan pulses to the scan lines of the plasma display panel according to the pulse width control signal.

The driving method may further comprise the step of outputting a timing control signal for setting one or both of a width of a reset pulse and/or a voltage level of the reset pulse applied in a reset period, wherein a timing control signal for setting the widths of the scan pulses depending on one or both of the width and/or the voltage level of the reset pulse, and depending on the location of either the upper or lower scan lines, is outputted.

The driving method may further comprise the step of determining a sub-field corresponding to a video signal, wherein a pulse width control signal for setting the widths of the scan pulses depending on the sub-field and depending on the location of either the upper or lower scan lines, is outputted.

The driving method may further comprise the step of receiving a video signal and calculating a data load of the video signal, wherein a pulse width control signal for setting the widths of the scan pulses depending on the data load of the video signal and depending on the location of the upper or lower scan lines, is outputted.

A pulse width control signal for increasing the widths of the scan pulses that are sequentially applied to the scan lines may be outputted.

A pulse width control signal for setting the widths of the scan pulses applied to the scan lines located in a first region to have a first width may be outputted. A pulse width control signal for setting the widths of the scan pulses, which are applied to the scan lines located in a second region subsequent to the first region, to have a second width narrower than the first width may be outputted. A pulse width control signal for setting the widths of the scan pulses, which are applied to the scan lines located in a third region subsequent to the second region, to have a third width wider than the second width may be outputted.

A pulse width control signal for setting widths of scan pulses applied to the scan lines located in a first region to be linearly reduced may be outputted. A pulse width control signal for setting the widths of the scan pulses, which are applied to the scan lines located in a second region subsequent to the first region, to remain constant may be outputted. A pulse width control signal for setting the widths of the scan pulses, which are applied to the scan lines located in a third region subsequent to the second region, to be linearly increased may be outputted.

A pulse width control signal for setting the width of the scan pulse applied to each of the scan lines to be linearly reduced and then increased linearly may be outputted.

In accordance with a plasma display apparatus and driving method thereof, scan pulse widths can be set depending on locations of scan lines. Therefore, high speed driving is possible, a sustain period can be secured and luminance can be increased.

The present invention will now be described in detail in connection with preferred embodiments with reference to the accompanying drawings.

Figure 3:
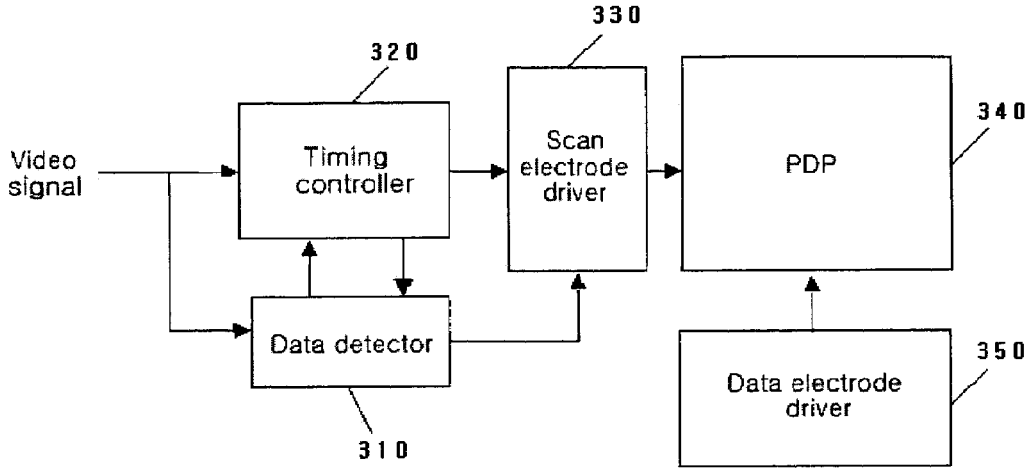
FIG. 3 is a block diagram of a plasma display apparatus according to the embodiment of the present invention.

FIG. 3 is a block diagram of a plasma display apparatus according to the embodiment of the present invention.

As shown in FIG. 3, the driving apparatus of the plasma display apparatus according to the present invention comprises a data detector 310, a timing controller 320, a scan electrode driver 330 and a plasma display panel 340.

<Plasma Display Panel>

The plasma display panel 340 comprises a plurality of scan lines that are arranged in parallel in a vertical direction.

<Data Detector>

The data detector 310 determines a sub-field corresponding to a video signal and calculates the data load. The data load of the video signal is similar to an APL. The APL is a value obtained by dividing the sum of the gray levels of cells constituting the plasma display panel by the total number of cells.

<Timing Controller>

The timing controller 320 outputs a pulse width control signal for setting timing for adjusting the width of a scan pulse depending on the location of the scan lines on the plasma display panel 340. The timing controller 320 outputs a timing control signal for setting one or both of a width of a reset pulse and/or a voltage level of the reset pulse applied in a reset period, and outputs a timing control signal for setting the widths of the scan pulses depending on one or both of the width of the reset pulse and/or the voltage level of the reset pulse, and depending on the location of either the upper or lower scan lines. The timing controller 320 can set the width of a scan pulse depending on the location of either the upper or lower scan lines, and depending on at least one of a data load and a sub-field of a video signal received from the data detector 310.

<Scan Electrode Driver>

The scan electrode driver 330 applies a scan pulse whose width is set according to the pulse width control signal received from the timing controller 320 to the scan lines of the plasma display panel 340.

The operation of the driving apparatus of the plasma display apparatus according to the present invention will be described in detail with reference to the drawings.

Figure 4:
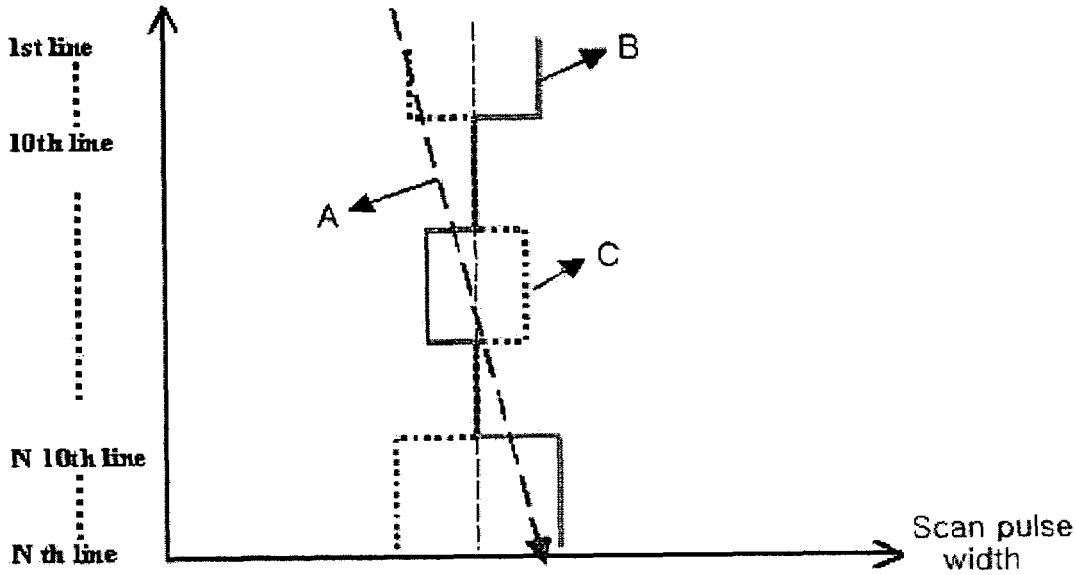
FIG. 4 shows a first embodiment for illustrating variations of the widths of scan pulses depending on the operation of the plasma display apparatus according to the embodiment of the present invention.

FIG. 4 shows a first embodiment for illustrating variations of the widths of scan pulses depending on the operation of the plasma display apparatus according to the embodiment of the present invention.

"A" of FIG. 4 will be described first. If the scan electrode driver 330 applies a reset pulse with a sufficiently high voltage level or a reset pulse having a sufficiently wide width according to the timing control signal output from the timing controller 320 of FIG. 3, sufficient charges are formed on the scan lines. The timing controller 320 outputs a pulse width control signal for setting a scan pulse applied to the scan line at a lower region to have a wider width. That is, the timing controller 320 outputs a pulse width control signal for linearly increasing the widths of the scan pulses that are sequentially applied to the scan lines.

As the location of the scan line becomes higher, wall charges that are formed under the influence of the reset pulse having the sufficiently great voltage level can be employed in a scan process. However, as the location of the scan line becomes lower, wall charges that are erased increase. Therefore, the timing controller 320 sets the widths of the scan pulses, which are applied to the respective scan lines, to be increased as the location of the scan lines moves from the top to the bottom. Therefore, the width of the scan pulse applied to the first scan line is the narrowest, and the width of the scan pulse applied to the last scan line ($N^{th}$ line) is the widest.

"B" of FIG. 4 will be described. If the scan electrode driver 330 applies a reset pulse with a low voltage level or a reset pulse having a narrow width according to the timing control signal output from the timing controller 320 of FIG. 3, insufficient charges are formed on the scan lines. The widths of scan pulses applied to the scan lines (a first line to a tenth line) located in a first region (i.e., an upper region), of all of the scan lines, are relatively wide. The widths of the scan pulses applied to the scan lines (an eleventh line to a $(N-10)^{th}$) located in a second region (i.e., a middle region) of all of the scan lines, are relatively narrow. The widths of the scan pulses applied to the scan lines (a $(N-9)^{th}$ line to a $N^{th}$ line) located in a third region (i.e., a lower region) of all of the scan lines, are relatively wide.

That is, if a voltage level of a reset pulse is low or a width of a reset pulse is narrow, the amount of the wall charges on the scan lines (the first line to the tenth line) in the first region (i.e., the upper region) is small, and the widths of the scan pulses applied to the scan lines (the first line to the tenth line) in the first region are relatively wide. Since a relatively great amount of the wall charges are accumulated on the scan lines (the eleventh line to the $(N-10)^{th}$ line) in the second region (i.e., the middle region) due to the influence of the wall charges on surrounding the scan lines, the widths of the scan pulses applied to the scan lines (the eleventh line to the $(N-10)^{th}$ line) in the second region are relatively narrow.

More particularly, the widths of scan pulses applied to some of the scan lines (the eleventh line to the $(N-10)^{th}$ line) in the second region are narrower than the widths of scan pulses applied to the remaining scan lines. Since the amount of the wall charges on the scan lines (the $(N-9)^{th}$ line to the $N^{th}$ line) in the third region (i.e., the lower region) is small due to the erasure of the majority of the wall charges, the widths of the scan pulses applied to the scan lines (the $(N-9)^{th}$ line to the $N^{th}$ line) in the lower region is relatively wide.

The plasma display apparatus constructed above according to an embodiment of the present invention can set pulse widths so that they become opposite to "B" of FIG. 4. That is, as in "C" of FIG. 4, the widths of the scan pulses applied to the scan lines (the first line to the tenth line) in the first region (i.e., the upper region), of all of the scan lines, are relatively narrow. The widths of the scan pulses applied to the scan lines (the eleventh line to the $(N-10)^{th}$ line) in the second region (i.e., the middle region) of all of the scan lines, are relatively wide. The widths of the scan pulses applied to the scan lines (the $(N-9)^{th}$ to the $N^{th}$ line) in the third region (i.e., the lower region) are relatively narrow. More particularly, the widths of scan pulses applied to some of the scan lines (the eleventh line to the $(N-10)^{th}$ line) in the second region are wider than the widths of the scan pulses applied to the remaining scan lines.

Figure 5:
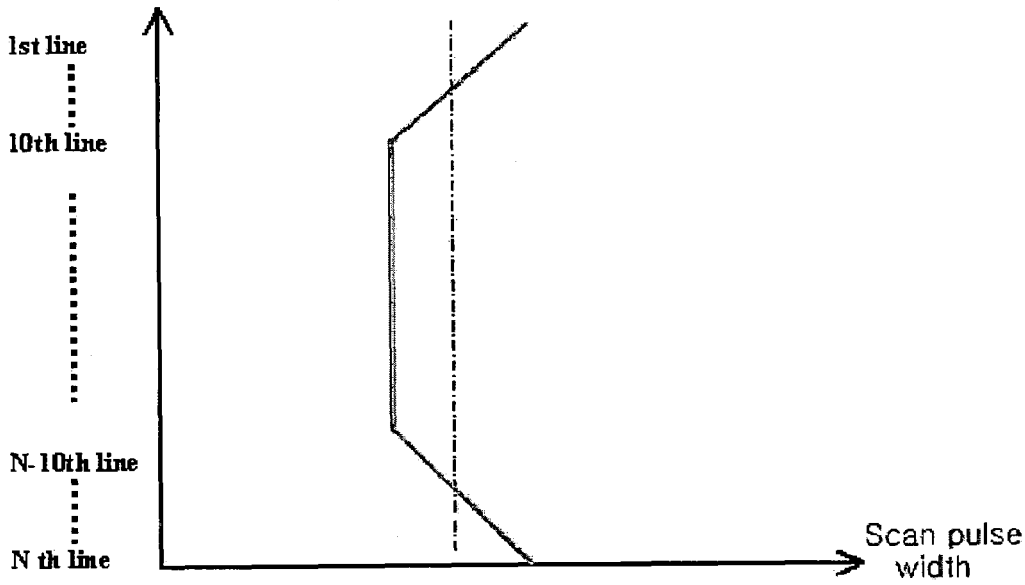
FIG. 5 shows a second embodiment for illustrating variations of the widths of scan pulses depending on the operation of the plasma display apparatus according to the embodiment of the present invention.

FIG. 5 shows a second embodiment for illustrating variations of the widths of scan pulses depending on the operation of the plasma display apparatus according to the embodiment of the present invention.

As shown in FIG. 5, the timing controller 320 outputs a pulse width control signal for setting widths of scan pulses to be linearly reduced, to the scan lines (the first line to tenth line) in the first region (i.e., an upper region), a pulse width control signal for setting widths of scan pulses to be constant, to the scan lines (the eleventh line to $(N-10)^{th}$ line) in the second region (i.e., a middle region), and a pulse width control signal for setting widths of scan pulses to be increased, to the scan lines (the $(N-9)^{th}$ line to $N^{th}$ line) in the third region (i.e., a lower region).

The reason why the timing controller 320 sets the widths of the scan pulses as described above is basically similar to the case of "B" of FIG. 4. That is, if the scan electrode driver 330 applies a reset pulse with a low voltage level or a reset pulse having a narrow width according to the timing control signal output from the timing controller 320 and an insufficient number of the wall charges are formed on the scan lines accordingly, the amount of the wall charges on the scan lines (the first line to the tenth line) in the first region is not great, the widths of the scan pulses applied to the scan lines (the first line to the tenth line) in the first region are linearly increased.

Since a relatively large number of the wall charges are accumulated on the scan lines (the eleventh line to the $(N-10)^{th}$ line) in the second region due to the influence of the wall charges on surrounding the scan lines, the widths of the scan pulses applied to the scan lines (the eleventh line to the $(N-10)^{th}$ line) in the second region remain constant. The constant width is narrower than the widths of the scan pulses applied to the scan lines (the first line to tenth line) in the first region.

Since the amount of the wall charges on the scan lines (the $(N-9)^{th}$ line to the $N^{th}$ line) in the third region is small due to the erasure of the majority of the wall charges, the widths of the scan pulses applied to the scan lines (the $(N-9)^{th}$ line to the $N^{th}$ line) in the third region are wider than the widths of the scan pulses applied to the scan lines (the $(N-9)^{th}$ line to $N^{th}$ line) in the second region and are linearly increased. In this case, a case where variation in the scan pulse widths shown in FIG. 5 is opposite is possible.

Figure 6:
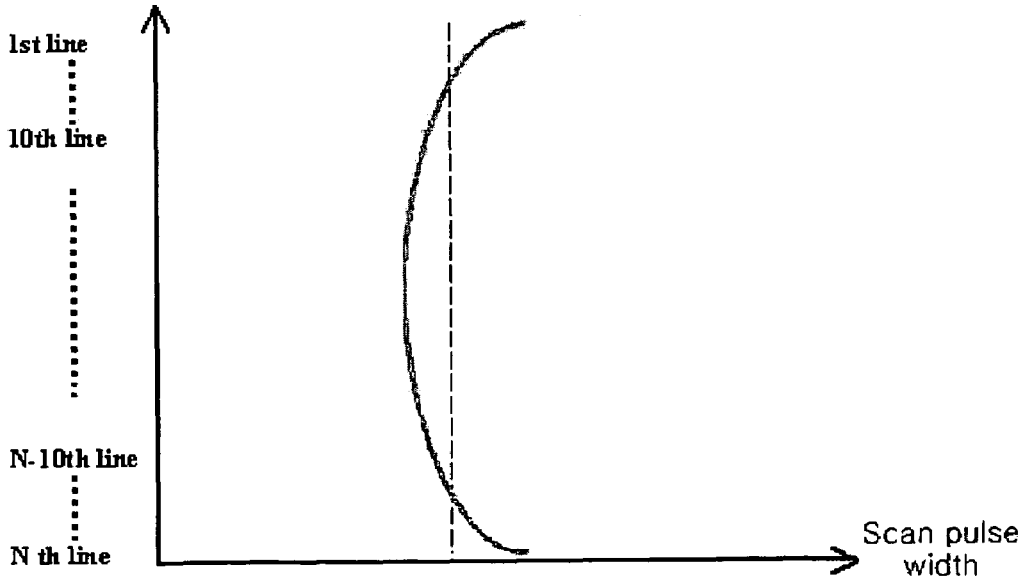
FIG. 6 shows a third embodiment for illustrating variations of the widths of scan pulses depending on the operation of the plasma display apparatus according to the embodiment of the present invention.

FIG. 6 shows a third embodiment for illustrating variations of the widths of the scan pulses depending on the operation of the plasma display apparatus according to the embodiment of the present invention.

As shown in FIG. 6, the timing controller 320 outputs a pulse width control signal for setting the widths of the scan pulses applied to the scan lines located at from the first half of a first region (i.e., an upper region) to a second region (i.e., a middle region), to be reduced non-linearly, and outputs a pulse width control signal for setting the widths of the scan pulses applied to the scan lines located at from the second half of the second region (i.e., the middle region) to a third region (i.e., a lower region), to be increase non-linearly.

The reason why the timing controller 320 sets the widths of the scan pulses as described above is basically similar to the case of "B" of FIG. 4.

Figure 7:
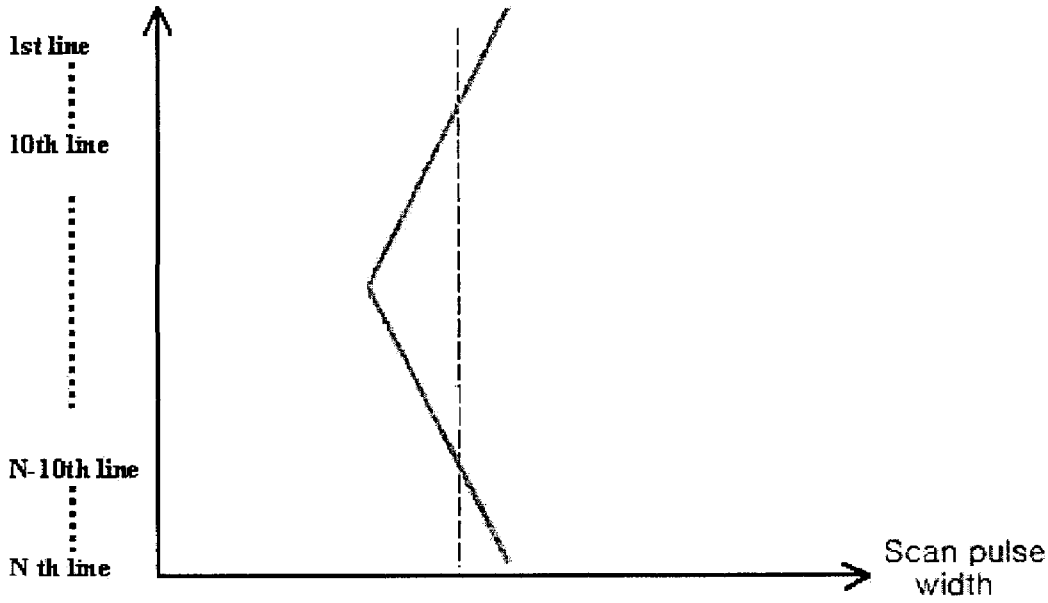
FIG. 7 shows a fourth embodiment for illustrating variations of the widths of scan pulses depending on the operation of the plasma display apparatus according to the embodiment of the present invention.

FIG. 7 shows a fourth embodiment for illustrating variations of the widths of the scan pulses depending on the operation of the plasma display apparatus according to the embodiment of the present invention.

As shown in FIG. 7, the timing controller 320 outputs a pulse width control signal for setting the widths of the scan pulses to be linearly reduced and then linearly increased. The reason why the timing controller 320 sets the widths of the scan pulses as described above is basically similar to the case of "B" of FIG. 4.

Such variation in the scan pulse width can be performed within one sub-field and can also be applied to patterns with different pulse widths on a sub-field basis. That is, the timing controller 320 sets the widths of the scan pulses depending on locations of the scan lines in consideration of an APL or a sub-field.

For example, the pattern as shown in "A" of FIG. 4 can be applied to sub-fields from a first sub-field to a fifth sub-field. The pattern as shown in "B" of FIG. 4 can be applied to sub-fields from a sixth sub-field to a tenth sub-field. The pattern as shown in "C" of FIG. 4 can be applied to sub-fields from an eleventh sub-field to a twelfth sub-field. The patters as shown in "A", "B" and "C" of FIG. 4 can be alternately applied to respective sub-fields.

As describe above, a scan pulse width is set. Therefore, although an address period is shortened according to high-speed driving when a plasma display apparatus is large-sized and has a high resolutions, an erroneous discharge or mis-writing can be prevented. A sustain period can be secured as an address period is shortened. Therefore, a plasma display apparatus with a high resolution can be realized.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A plasma display apparatus, comprising:

a plasma display panel in which a plurality of scan lines is arranged in parallel in a vertical direction;

a timing controller that outputs a control signal for controlling a reset pulse and scan pulses; and a scan electrode driver that applies the reset pulse and the scan pulses to the scan lines of the plasma display panel according to the control signal received from the timing controller, wherein the widths of the scan pulses are different from each other depending on locations of the scan lines on the plasma display panel and depending on at least one of a width of the reset pulse and a voltage of the reset pulse.

2. The plasma display apparatus as claimed in claim 1, further comprising a data detector that determines a sub-field corresponding to a video signal, wherein the timing controller outputs a pulse width control signal for setting the widths of the scan pulses depending on the sub-field and depending on the location of either the upper or lower scan lines.

3. The plasma display apparatus as claimed in claim 1, further comprising a data detector that receives a video signal and calculates a data load of the video signal, wherein the timing controller outputs a pulse width control signal for setting the widths of the scan pulses depending on the data load of the video signal and depending on the location of either the upper or lower scan lines.

4. The plasma display apparatus as claimed in claim 1, wherein the timing controller outputs a pulse width control signal for increasing the widths of the scan pulses that are sequentially applied to each of the scan lines.

5. The plasma display apparatus as claimed in claim 1, wherein the timing controller outputs a pulse width control signal for setting the widths of the scan pulses applied to the scan lines located in a first region to have a first width, outputs a pulse width control signal for setting the widths of the scan pulses applied to the scan lines located in a second region subsequent to the first region to have a second width narrower than the first width, and outputs a pulse width control signal for setting the widths of the scan pulses applied to the scan lines located in a third region subsequent to the second region to have a third width wider than the second width.

6. The plasma display apparatus as claimed in claim 5, wherein the timing controller outputs a pulse width control signal for setting the widths of the scan pulses applied to some of the scan lines located in the second region to be narrower than the widths of the scan pulses applied to the remaining scan lines.

7. The plasma display apparatus as claimed in claim 1, wherein the timing controller outputs a pulse width control signal for setting the widths of the scan pulses applied to the scan lines located in a first region to have a first width, outputs a pulse width control signal for setting the widths of the scan pulses applied to the scan lines located in a second region subsequent to the first region to have a second width wider than the first width, and outputs a pulse width control signal for setting the widths of the scan pulses applied to the scan lines located in a third region subsequent to the second region to have a third width narrower than the second width.

8. The plasma display apparatus as claimed in claim 7, wherein the timing controller outputs a pulse width control signal for setting the widths of scan pulses applied to some of the scan lines located in the second region to be wider than the widths of the scan pulses applied to the remaining scan lines.

9. The plasma display apparatus as claimed in claim 1, wherein the timing controller outputs a pulse width control signal for setting the widths of the scan pulses applied to the scan lines located in a first region to be linearly reduced, outputs a pulse width control signal for setting the widths of the scan pulses applied to the scan lines located in a second region subsequent to the first region to be constant, and outputs a pulse width control signal for setting the widths of the scan pulses applied to the scan lines located in a third region subsequent to the second region to be linearly increased.

10. The plasma display apparatus as claimed in claim 1, wherein the timing controller outputs a pulse width control signal for setting the width of the scan pulse applied to each of the scan lines to be non-linearly reduced and then to be increased non-linearly.

11. The plasma display apparatus as claimed in claim 1, wherein the timing controller outputs a pulse width control signal for setting the width of the scan pulse applied to each of the scan lines to be linearly reduced and then to be increased linearly.

12. A driving method of a plasma display apparatus in which a plurality of scan lines is arranged in parallel in a vertical direction, comprising:

outputting a timing control signal for setting at least one of a width and a voltage level of a reset pulse;

outputting a control signal for setting the widths of scan pulses to be different from each other depending on locations of the scan lines on the plasma display panel and depending on one or both of the width and the voltage level of the reset pulse;

applying the reset pulse and the scan pulses to the scan lines of the plasma display panel.

13. The driving method as claimed in claim 12, further comprising the step of determining a sub-field corresponding to a video signal, wherein a pulse width control signal for setting the widths of the scan pulses depending on the sub-field and depending on the location of either the upper or lower scan lines, is outputted.

14. The driving method as claimed in claim 12, further comprising the step of receiving a video signal and calculating a data load of the video signal, wherein a pulse width control signal for setting the widths of the scan pulses depending on the data load of the video signal and depending on the location of the upper or lower scan lines, is outputted.

15. The driving method as claimed in claim 12, wherein a pulse width control signal for increasing the widths of the scan pulses that are sequentially applied to the scan lines is outputted.

16. The driving method as claimed in claim 12, wherein a pulse width control signal for setting the widths of the scan pulses applied to the scan lines located in a first region to have a first width is outputted, a pulse width control signal for setting the widths of the scan pulses, which are applied to the scan lines located in a second region subsequent to the first region, to have a second width narrower than the first width is outputted, and a pulse width control signal for setting the widths of the scan pulses, which are applied to the scan lines located in a third region subsequent to the second region, to have a third width wider than the second width is outputted.

17. The driving method as claimed in claim 12, wherein a pulse width control signal for setting widths of scan pulses applied to the scan lines located in a first region to be linearly reduced is outputted, a pulse width control signal for setting the widths of the scan pulses, which are applied to the scan lines located in a second region subsequent to the first region, to remain constant is outputted, and a pulse width control signal for setting the widths of the scan pulses, which are applied to the scan lines located in a third region subsequent to the second region, to be linearly increased is outputted.

18. The driving method as claimed in claim 12, wherein a pulse width control signal for setting the width of the scan pulse applied to each of the scan lines to be linearly reduced and then increased linearly is outputted.

19. A driving method of a plasma display apparatus in which a plurality of scan lines is arranged in parallel on a plasma display panel in a vertical direction, comprising:

applying a reset pulse to the plurality of the scan lines during a reset period of one sub-field; and applying a scan pulse to each of the plurality of the scan lines during an address period of the one sub-field subsequent to the reset period, wherein the widths of scan pulses which are applied to the plurality of the scan lines during the address period of one sub-field, are different from each other in accordance with a location of the scan lines arranged on the plasma display panel and in accordance with at least one of a width of the reset pulse and a voltage level of the reset pulse.

20. The driving method as claimed in claim 19, wherein the widths of scan pulses which are applied to the plurality of the scan lines arranged on the upper part of the plasma display panel, are narrower than the widths of scan pulses which are applied to the plurality of the scan lines arranged on the lower part of the plasma display panel.

* * * * *